US006398526B1

(12) United States Patent
Yang

(10) Patent No.: US 6,398,526 B1
(45) Date of Patent: Jun. 4, 2002

(54) AXIAL (RADIAL) FLOW FAN

(76) Inventor: Pei-Ju Yang, 9F, No. 103, Sec. 1, Huan-He N. Rd., Taipei (TW)

( * ) Notice: Subject to any disclaimer, the term of this patent is extended or adjusted under 35 U.S.C. 154(b) by 0 days.

(21) Appl. No.: 09/689,894

(22) Filed: Oct. 13, 2000

(51) Int. Cl.[7] ..... F04B 17/00
(52) U.S. Cl. ..... 417/423.7
(58) Field of Search ..... 417/423.7, 354; 416/174, 244 R

(56) References Cited

U.S. PATENT DOCUMENTS 4,063,850 A * 12/1977 Hueber et al. ..... 416/244 R
4,806,081 A * 2/1989 Harmsen et al. ..... 417/423.14
5,135,363 A * 8/1992 Harmsen et al. ..... 417/354

* cited by examiner

*Primary Examiner*—Teresa Walberg
*Assistant Examiner*—Vinod D Patel
(74) *Attorney, Agent, or Firm*—Bacon & Thomas

(57) ABSTRACT

An axial (radial) flow fan is disclosed. The rotary shaft is made of ceramic material and includes a channel passing through the body of the rotary shaft. When the rotary shaft is placed in a mold and plastic material fills the mold, the plastic material passes through the channel of the rotary shaft to extend to a free end of the rotary shaft so as to form a retaining portion, for combining the plastic material and rotary shaft. Since the bearing is made of ceramic material to have a tube shape, it may be tightly arranged at the hollow post of the fan seat. The rotary shaft is then inserted into the bearing and the retaining portion of the rotary shaft formed or secured so that the blade set will not separate with the bearing.

7 Claims, 6 Drawing Sheets

AXIAL (RADIAL) FLOW FAN

BACKGROUND OF THE INVENTION

The present invention relates to an axial (radial) flow fan, and especially to a fan in which the rotary shaft and bearing are made of ceramics.

Currently, small size fans are used in the heat dissipating device of a microprocessor, and can be directly adhered to the surface of a microprocessor or firmly secured to a radiating piece so as to dissipate heat from the microprocessor or the radiating piece and thereby ensure that the microprocessor can run various softwares correctly.

The prior art small type axial (radial) flow fan includes a blade set and a fan seat. The seat has a hollow post. A copper bearing and a stainless steel bearing are arranged in the hollow post. A coil is installed outside of the hollow post. The blade set is formed with a cap and blades connected to the cap. A magnet pushed by magnetic force and a stainless steel rotary shaft supported by the two bearings is arranged within the cap. As the aforesaid coil generates a magnetic force, the magnet is pushed to cause the blades to operate and produce a wind with a wind pressure.

Since the aforesaid stainless steel rotary shaft is arranged on the copper and stainless steel bearings to rotate, after rotating for a period of time, the rotary shaft and bearing will wear and, thus, the lifetime of the fan will be reduced. Moreover, the copper bearing has a thick wall so that the inner diameter of the hollow post in the fan seat is also increased. After the inner diameter of the hollow post is increased, the outer diameter of the coil and blade set are also enlarged so that the output wind amount and wind pressure are reduced and thus the wind cannot blow to a farther place.

Furthermore, the prior art fan has many parts. Not only is the assembly and working sequences of the prior art fan complex, so that much working time is required, but the manufacturing cost is also high.

SUMMARY OF THE INVENTION

Accordingly, the primary object of the present invention is to provide an axial (radial) flow fan in which the defects in the prior art are alleviated. In the present invention, a sheath surrounding the rotary shaft and a bearing in the fan are made of ceramic material. Since the ceramic material is heat-durable and wear-tolerable, after the rotary shaft operates in the bearing for an extended period of time, no mechanical fault and no physical variation occurs so that the rotary shaft operates in the bearing.

Another object of the present invention is to provide an axial (radial) flow fan, wherein the tube wall of the bearing made of ceramics is thin. Therefore, as the fan seat is manufactured; the inner diameter of the hollow post can be reduced. Accordingly, the outer diameter of the coil and the inner diameter of the cap reduce. Not only the output wind amount increases, but also the wind pressure increases. Therefore, wind can be transferred to a farther place.

A further object of the present invention is to provide an axial (radial) flow fan, in which the assembled time and working sequences are saved, and therefore the manufacturing cost is reduced.

To achieve the above objects, an axial (radial) flow fan is disclosed. After the rotary shaft is made of ceramic material, the rotary shaft is installed with a channel passing through the body of the rotary shaft. The rotary shaft is placed in a mold. As plastic material is filled into the mold to form the blade set, the plastic material passes through the channel of the rotary shaft to extend to a free end of the rotary shaft so as to form a retaining portion, and therefore, the plastic material and rotary shaft are combined. After the bearing is made of ceramic material to have a tube shape, it is tightly arranged at the hollow post of the fan seat. Then the aforesaid rotary shaft is inserted into the bearing. The retaining portion of the rotary shaft is arranged with a fastening member or extension so that the blade set will not separate from the bearing.

The various objects and advantages of the present invention will be more readily understood from the following detailed description when reading in conjunction with the appended drawing.

DETAILED DESCRIPTION OF THE PREFERRED EMBODIMENTS

Figure 1:
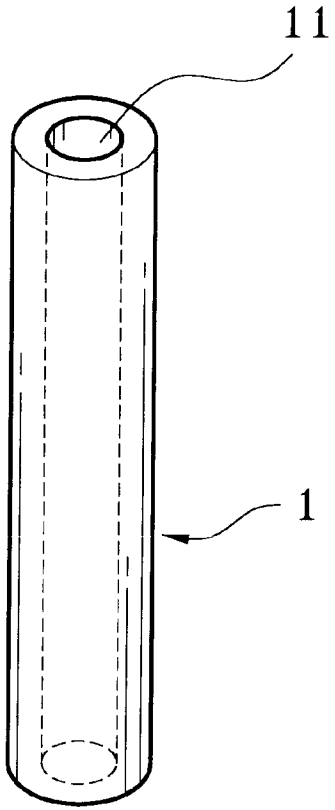
FIG. 1 is a schematic perspective view showing the appearance of the axial (radial) flow fan in the present invention.
Figure 2:
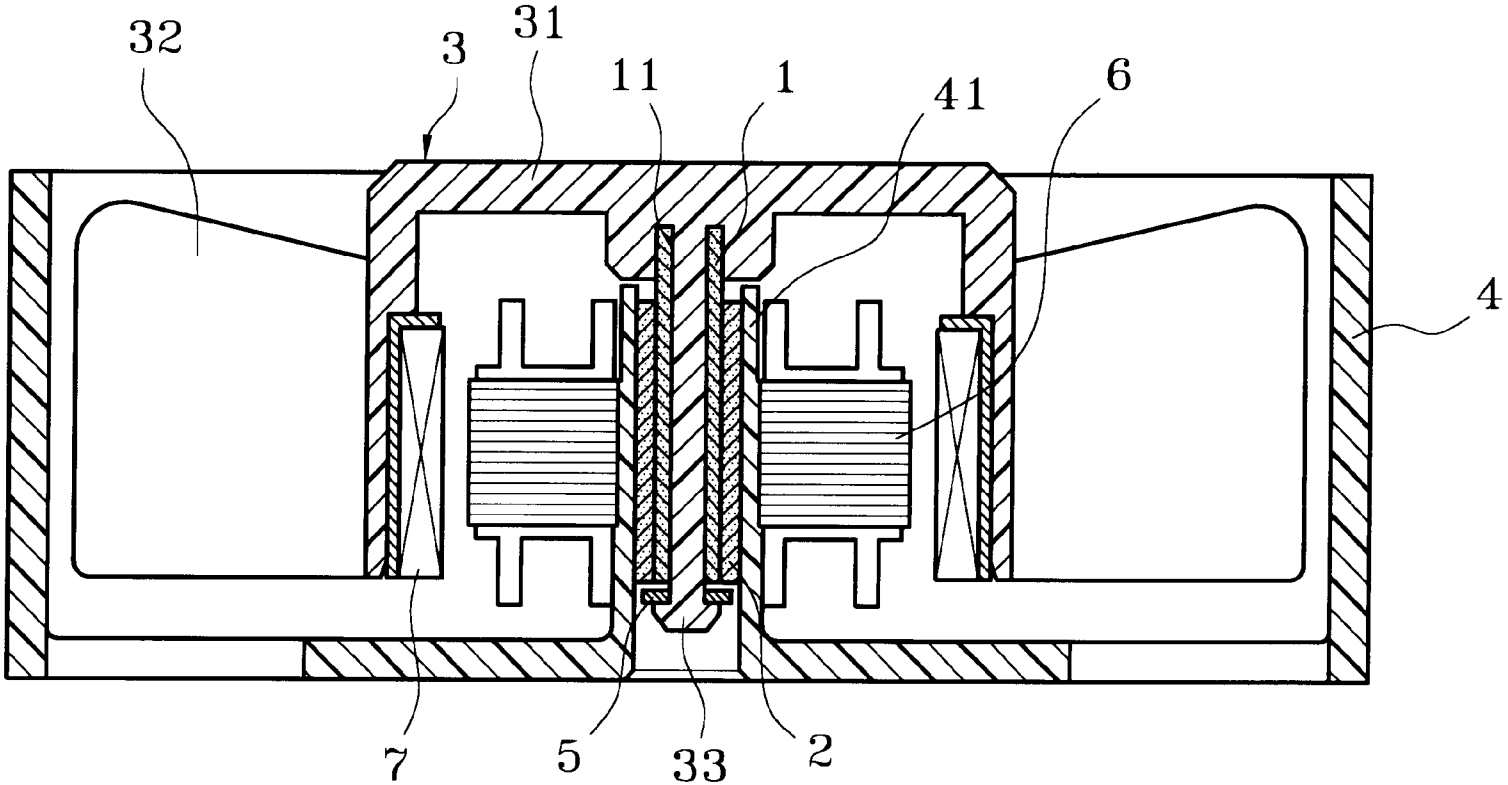
FIG. 2 is a cross sectional view of the fan in the present invention.
Figure 3:
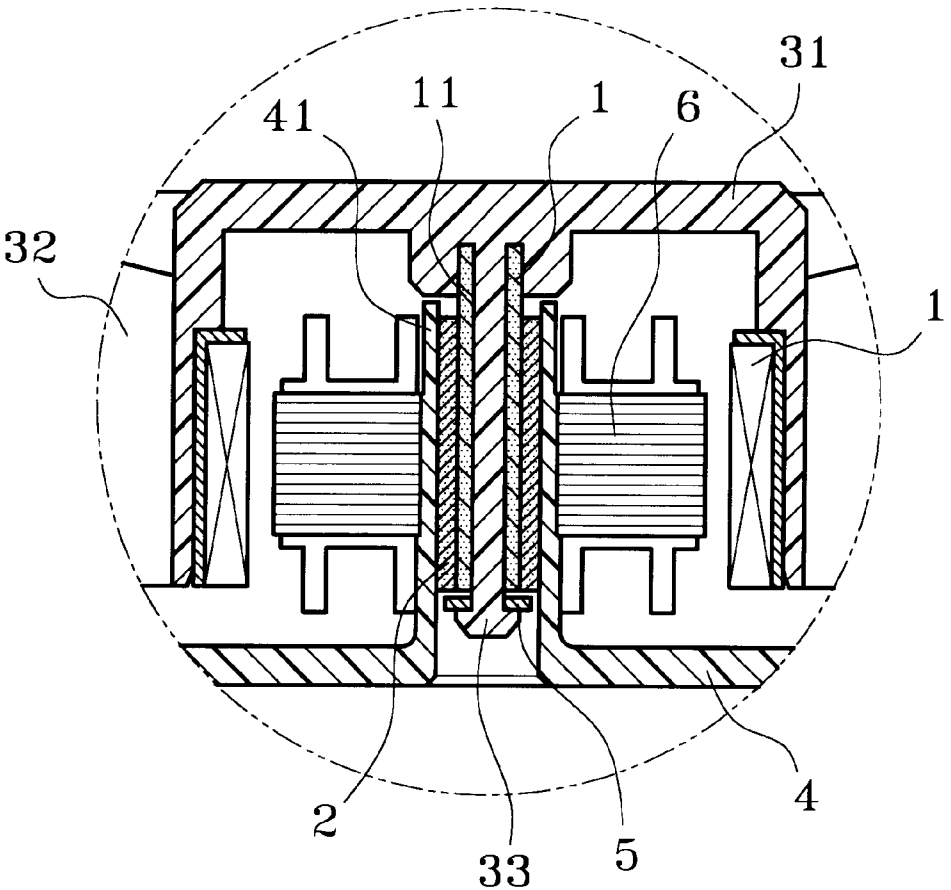
FIG. 3 is a partial enlarged view of FIG. 2.

With reference to FIGS. 1, 2 and 3, the rotary shaft of a fan according to the present invention is illustrated. As shown in the figures, in the axial (radial) flow fan of the present invention, the rotary shaft 1 and bearing 2 used in the fan are made of ceramic material so that in addition to successful operation of the fan, the wind output and wind pressure can be increased.

After the rotary shaft 1 is made of ceramic material, the rotary shaft 1 is installed with a channel 11 passing through the body of the rotary shaft 1. The rotary shaft 1 is placed in the mold (not shown). As plastic material (not shown) is filled into the mold, plastic material will be formed with cap 31 and blade set 3 including blades 32. Moreover, the plastic material passes through the channel 11 of the rotary shaft 1 to extend to a free end of the rotary shaft 1 so as to form a retaining portion 33, and therefore, the plastic material and rotary shaft 1 are combined.

After the bearing 2 is made of ceramic material to have a tube shape, it is tightly arranged at the hollow post 41 of the fan seat 4. Then the aforesaid rotary shaft 1 is inserted into the bearing 2. The retaining portion 33 of the rotary shaft 1 is arranged with a fastening member 5 so that the blade set 3 will not separate from the bearing 2. As the fan is conductive, the coil 6 outside the hollow post 41 will generate a magnetic force to push the magnet 7 within the cap 31 so that the blade set 3 operates, and thus wind blows out. Therefore, a novel axial (radial) flow fan is formed.

Since the ceramic material is heat-durable and wear-tolerable, after the rotary shaft 1 operates in the bearing 2 for a long period of time, no mechanical fault and no physical variation occurs so that the rotary shaft 1 steadily operates in the bearing 2.

Furthermore, since the rotary shaft 2 is made of ceramic material, the tube wall of the bearing 2 is thin. Therefore, as the fan seat 4 is manufactured, the inner diameter of the hollow post 41 can be reduced. Accordingly, the outer diameter of the coil 6 and the inner diameter of the cap 31 is also reduced. Not only the output wind amount increases, but also the wind pressure increases eliminating or reducing the prior art defects of small wind amount and wind pressure.

Figure 4B:
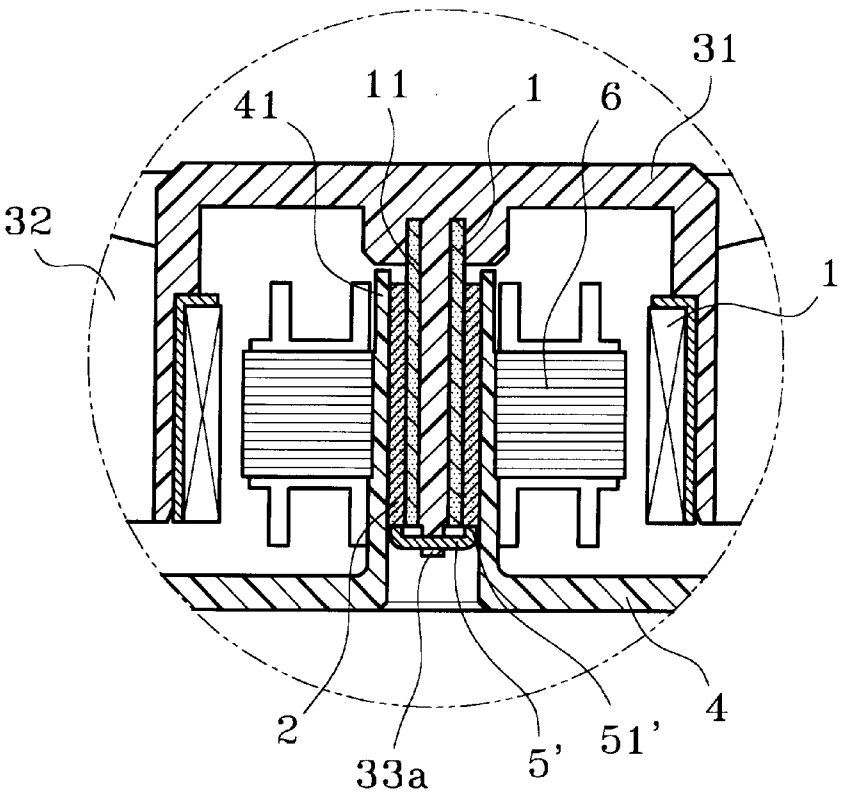
FIGS. 4A and 4B are the schematic views of the first embodiment in the present invention.
Figure 4A:
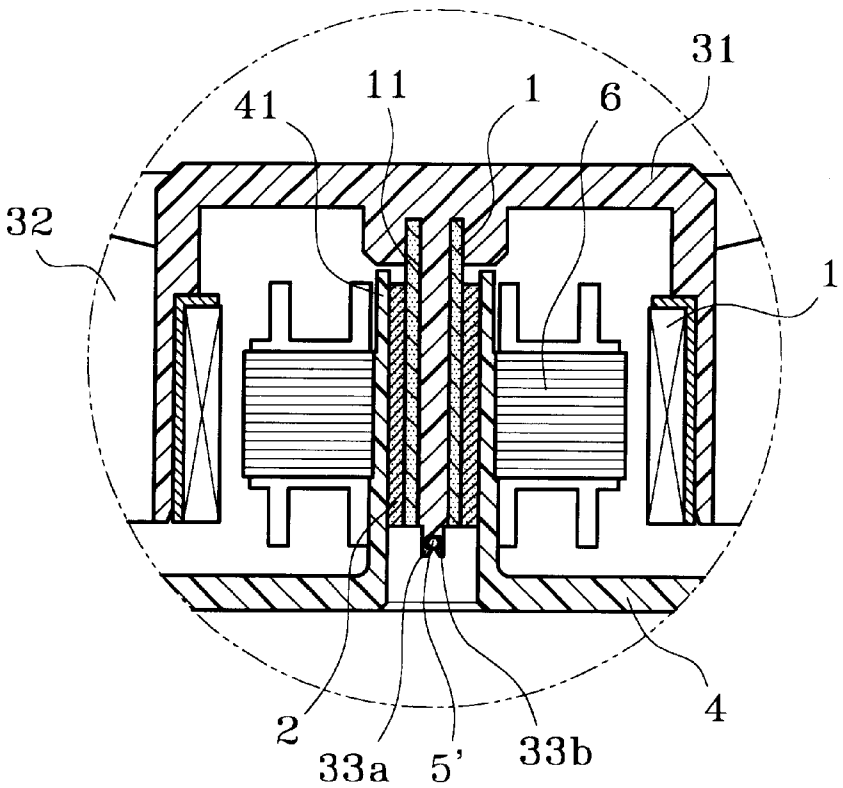

Referring to FIGS. 4A and 4B, a schematic view of the first embodiment of the present invention is illustrated. As shown in the figures, as the rotary shaft 1 is located in a mold and is combined with a plastic material, the plastic material passing through the channel 11 is formed as two opposite reverse hooks 33*a* and 33*b* so that fastening member 5' with the bending portions 51' is secured to the two reverse hooks 33*a* and 33*b* for preventing the blade set 3 from separating from the bearing 2.

Figure 5B:
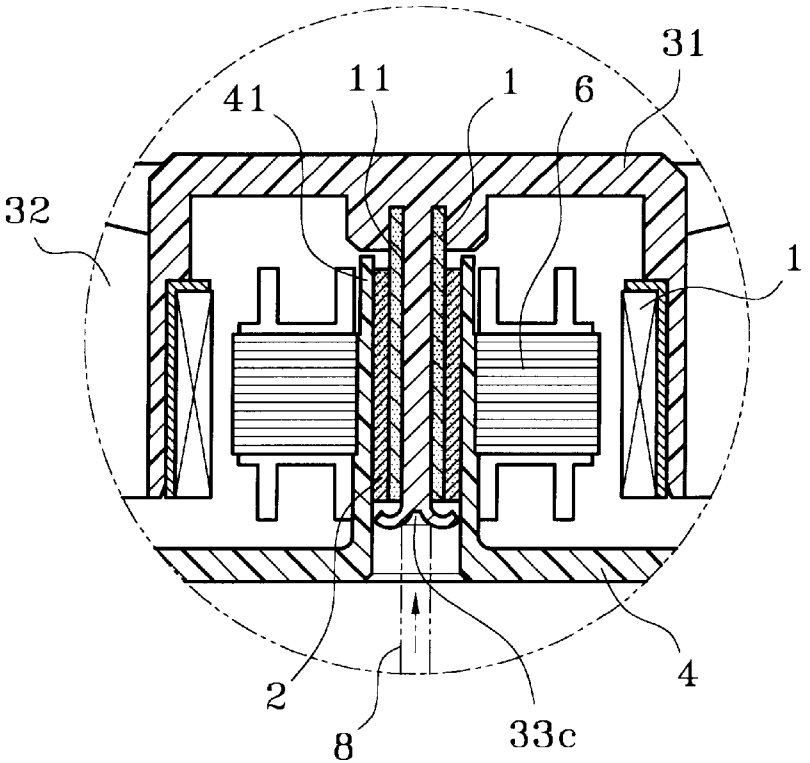
FIGS. 5A and 5B are the schematic views of the second embodiment in the present invention.
Figure 5A:
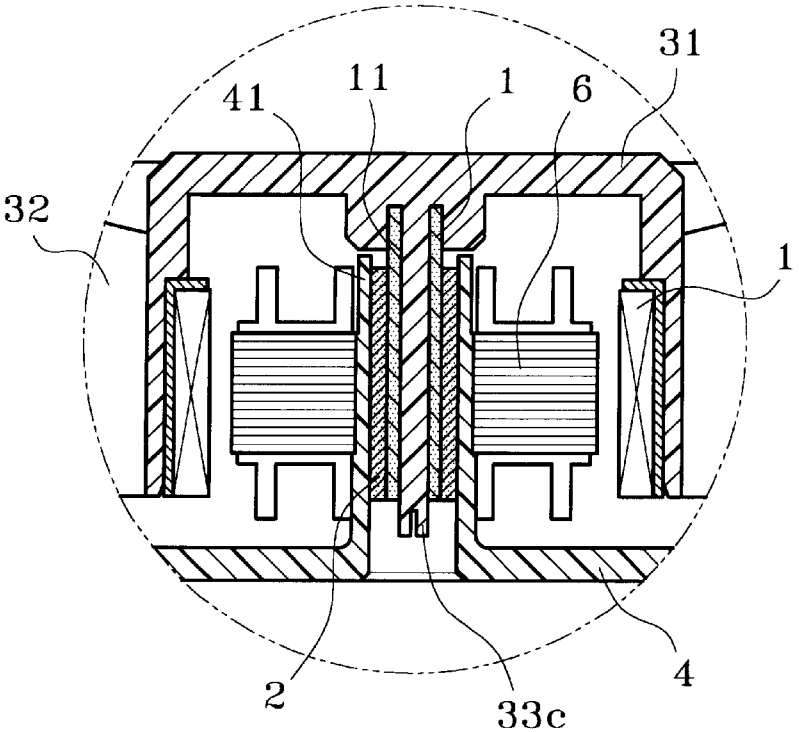

Referring to FIGS. 5A and 5B, a schematic view of the second embodiment of the present invention is illustrated. As shown in the figures, as the rotary shaft 1 is located in a mold and is combined with a plastic material, the plastic material passing through the channel 11 will be formed with a slot 33*c*. As the plug 8 is inserted into the plastic material. The two sides of the slot 33*c* are expanded outwards so as to form a stop for preventing the blade set 3 from separating from the bearing 2.

Figure 6:
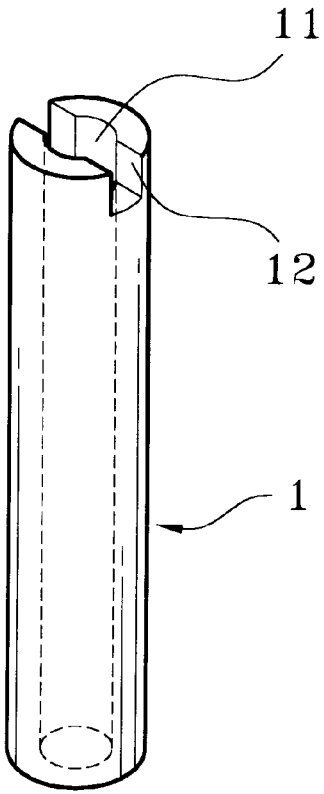
FIG. 6 is a schematic view of the third embodiment in the present invention.

With reference to FIG. 6, a schematic view showing the third embodiment of the present invention is illustrated. As shown in the figure, the free end of the rotary shaft 1 is further installed with a concave portion 12 identical to the channel 11. As the rotary shaft 1 is placed in the mold and plastic material is filled therein, the plastic material will fill the concave portion 12 so that the plastic material can be steadily combined with the rotary shaft 1.

Furthermore, because the rotary shaft 1 and the bearing 2 are made of ceramic material, not only can blade set 3 be operated for a long period of time on the fan seat 4, but also the lifetime of the fan is prolonged.

The above described embodiments are not intended to limit the scope of the present invention, as one skilled in the art can, in view of the present invention, expand such embodiments to correspond with the subject matter of the present invention claimed below. Therefore, all such substitutions and modifications are intended to be embraced within the scope of the invention as defined in the appended claims.

What is claimed is:

1. A fan comprising a blade set, a rotary shaft, and a fan seat, the seat having a hollow post, the hollow post having a coil supported by the hollow post and a bearing positioned within the hollow post;

wherein the coil generates a magnetic force to push a magnet within the blade set so that the fan is operated, wherein the blade set includes a cap and a retaining portion extending from the cap, wherein the rotary shaft includes a passage, is made of ceramic material, and is inserted into the bearing, wherein the retaining portion of the blade set extends from the cap through the passage in the rotary shaft, and wherein the rotary shaft is secured to the rotary shaft and retained within the bearing by a free end of the retaining portion extending through the passage in the rotary shaft to prevent the blade set, the rotary shaft, and the bearing from separating.

2. The fan as claimed in claim 1, wherein the retaining portion includes two opposite reverse hooks.

3. The fan as claimed in claim 1, wherein the retaining portion includes a slit.

4. The fan as claimed in claim 1, wherein the retaining portion includes a retaining member and said retaining member includes bending portions at two ends.

5. The fan as claimed in claim 1, wherein the retaining portion includes a cylindrical plug.

6. A method of manufacturing the fan of claim 1, comprising the steps of providing said rotary shaft; and forming the retaining portion by causing plastic to flow through said passage in the rotary shaft during formation of the blade set to form a cap at the free end of the rotary shaft.

7. A method of manufacturing as claimed in claim 6, further comprising the step of bending ends of the retaining portion to form hooks which prevent the shaft from separating from the bearing.

* * * * *